United States Patent [19]

Duncan

[11] Patent Number: 4,892,169

[45] Date of Patent: Jan. 9, 1990

[54] PERIMETER DEBRIS NET LIFTING SYSTEM

[75] Inventor: Charles W. Duncan, Costa Mesa, Calif.

[73] Assignee: Sinco, Inc., East Hampton, Conn.

[21] Appl. No.: 313,089

[22] Filed: Feb. 21, 1989

[51] Int. Cl.[4] ..... E04G 21/30; E04G 21/32

[52] U.S. Cl. ..... 182/138; 182/82

[58] Field of Search ..... 182/138, 139, 137, 82, 182/136

[56] References Cited

U.S. PATENT DOCUMENTS

| | | | |
|---|---|---|---|
| 4,119,176 | 10/1978 | Verdu | 182/138 |
| 4,129,197 | 12/1978 | Preston | 182/138 |
| 4,732,234 | 3/1988 | Brickman | 182/82 |
| 4,838,382 | 6/1989 | Nusbaum | 182/138 |

*Primary Examiner*—Reinaldo P. Machado

*Attorney, Agent, or Firm*—Chilton, Alix & Van Kirk

[57] ABSTRACT

A perimeter debris net lifting system employs a plurality of lifting units which support a debris net for a high rise-type construction structure. The lifting units comprise a pair of frame assemblies which are slidably coupled and essentially scale the structure to raise the debris net as construction progresses. Each of the frame assemblies are independently mountable to two floors of the structure. Each lifting unit is vertically displaced by disengaging one of the frame assemblies from its mounting engagement and lifting the frame assembly while the other frame assembly remains securely fixed to the structure. The debris net remains fully extended and functional during the vertical lifting process.

32 Claims, 9 Drawing Sheets

PERIMETER DEBRIS NET LIFTING SYSTEM

BACKGROUND OF THE INVENTION

This invention relates generally to debris nets employed in connection with high rise construction projects, including structural steel beam structures, for catching debris which falls from uncompleted floors of the building. More particularly, this invention relates to devices and systems for adjusting the vertical height of perimeter debris nets as construction progresses.

Debris nets have been employed as safety barriers for a number of years to protect workers and others from falling debris at high rise construction projects. Various governmental and regulatory bodies have implemented safety regulations which specify the netting requirements, including the height of the netting in relation to the uncompleted portions of the construction project. Most pertinent safety regulations require that the debris net be raised as the construction project progresses through the upper portions of the structure.

A number of devices, including those disclosed in the patent literature, employ means for mounting the debris net to the high rise construction project, as well as means for sequentially mounting the debris net at increasing heights during the progress of the construction. While a number of devices employ means for efficiently mounting the debris net to the high rise structure, repositioning of the debris net to a new height is generally quite labor intensive and time consuming. Commonly, the debris net is completely dismounted from its supporting structure and is physically moved to the new height and remounted in position. Such a repositioning process is not only inefficient, but introduces certain safety deficiencies since there are periods of time in which the debris net is not functional or two levels of nets are required.

A number of devices have been proposed for implementing a more efficient method of raising the debris net from one height level to another as the construction progresses. Most of the technology has been directed to track-type systems wherein tracks of various forms are vertically mounted to the high rise structure. The debris net is mounted to supports which connect with the tracks. For example, U.S. Pat. No. 4,119,176 discloses a Y-shaped support structure for a debris net. The support structure is movably attached at two of its arms to a track which is vertically mounted adjacent to the face of the building. The arms are engaged in a slot in the track. The support structures and attached net are raised by removing the supports from the upper arms and sliding the ends of the upper arm upward while folding the net toward the building. The upper arms are then supported while simultaneously unfolding the support structure outwardly and finally providing a support for the bottom arms of the Y-shaped support structures.

SUMMARY OF THE INVENTION

Briefly stated, the invention in a preferred form is a perimeter debris net lifting system which employs a plurality of lifting units. The lifting units sequentially climb a series of vertically spaced platforms or floors of a construction structure to provide a moveable support for the debris net. The lifting unit comprises an inner support frame which may be independently detachably mounted to two of the platforms to provide a rigid support. A rigid support frame is positionable in a generally upright orientation which is spaced transversely from the platforms at a first distance. A lower inner attachment leg is connected to the inner support frame to provide an attachment to one platform. The attachment leg is positionable to permit vertical displacement of the inner support frame while generally maintaining the first distance from the platforms. An upper inner attachment arm is connected to the inner support frame for attachment to a second platform. The upper inner arm attachment is positionable to permit vertical displacement of the inner support frame between platforms while maintaining the first distance. Cooperative guide members are disposed in fixed relationship to the inner support frame.

A second outer lifting frame is slidably received in the guide members for detachable mounting to two platforms to provide a rigid support. The second frame comprises an outer lifting frame which is positionable in a generally upright orientation which is spaced transversely from the platforms at a second distance. A lower outer attachment leg connects to the outer lifting frame for attachment to one of the platforms. The lower outer attachment leg is positionable to permit vertical displacement of the outer frame between platforms while generally maintaining the second distance. An upper outer attachment arm connects to the outer lifting frame for attachment to another platform. The upper outer attachment arm is positionable to permit vertical displacement of the outer frame between platforms while maintaining the second distance. The debris net is supported by the lifting frame.

A hydraulic cylinder is mounted in fixed relationship to the inner support frame. The cylinder is activatible to lift the outer lifting frame relative to the inner support frame when the position of the first frame is substantially fixed at two of the platforms. The hydraulic cylinder also functions to lift the inner frame relative to the outer frame when the position of the outer frame is substantially fixed to two of the platforms. A hoisting chain connects to the outer frame. A ratchet drive selectively engages the chain to provide a ratchet drive in one of two directional drive modes. The ratchet drive is powered by the hydraulic cylinder. The inner support frame is adjustable to vary the effective length of the inner support frame.

The lower inner attachment leg comprises a turnbuckle and a pair of T-connectors threadably receives by the turnbuckle. The upper inner attachment arm is pivotally connected to the inner support frame. The outer lifting frame further comprises a generally longitudinally extending support post having an extension at an upper end portion thereof. The extension extends at an angle so that the debris net may be suspended relatively close to the face of the platforms. A perimeter arm projects outwardly from the support post to suspend the net outwardly from the building. The upper outer attachment arm also has means for variably adjusting the length of the arm.

A mounting plate which is employed for fastening or anchoring the lifting units to the floors of the platforms of the structure has openings for receiving concrete fasteners. A pair of spaced upstanding brackets have first and second sets of pairs of aligned apertures. The inner frame is attached to the brackets through one set of apertures. The outer frame may be attached to the bracket through the other set of apertures. A key plate which defines an eccentric slot is receivable in an opening of the mounting plate. The key plate is angularly adjustable so that an anchor for the plate may be suitably located to avoid engagement with the steel enforcement rods or other obstructions to the fastener.

An object of the invention is to provide a new and improved debris net lifting system which can be employed to lift a perimeter debris net from one vertical height to another in a very efficient manner.

Another object of the invention is to provide a new and improved debris net lifting system which can be moved from one height to another while maintaining the debris net in a fully functional open position.

A further object of the invention is to provide a new and improved debris net lifting system which can be raised and/or lowered in an efficient manner without requiring the construction of a track system.

Other objects and advantages of the invention will become apparent from the drawings and the specification.

DETAILED DESCRIPTION OF THE INVENTION

Figure 15:
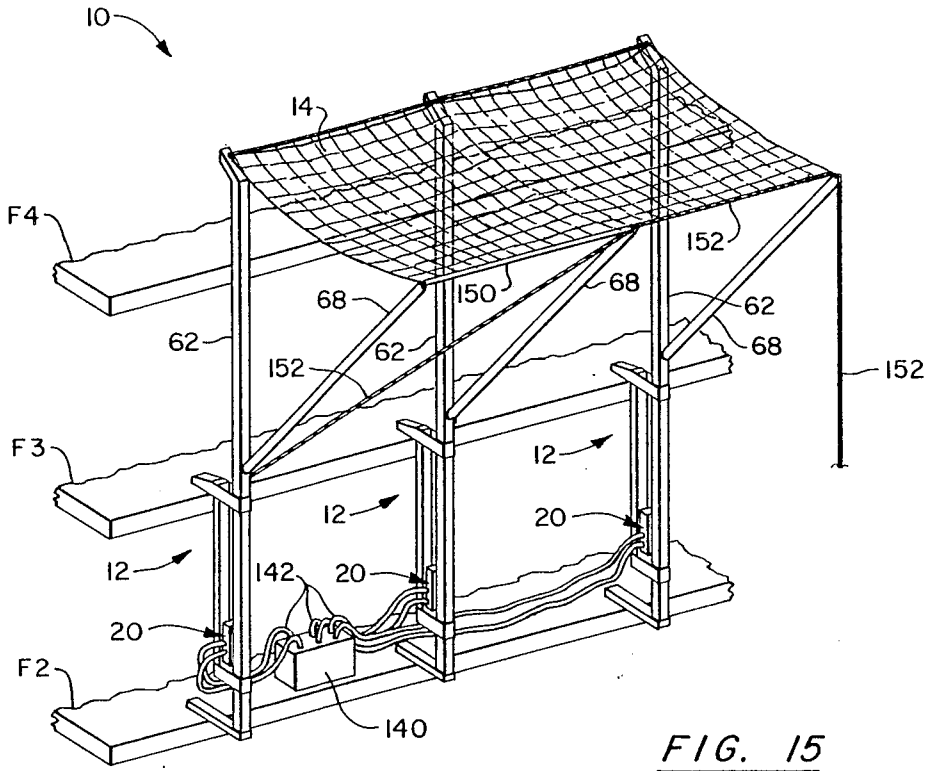
FIG. 15 is a front view of the debris net lifting system of FIG. 1, portions of the construction structure and power supply being illustrated in schematic.
Figure 17:
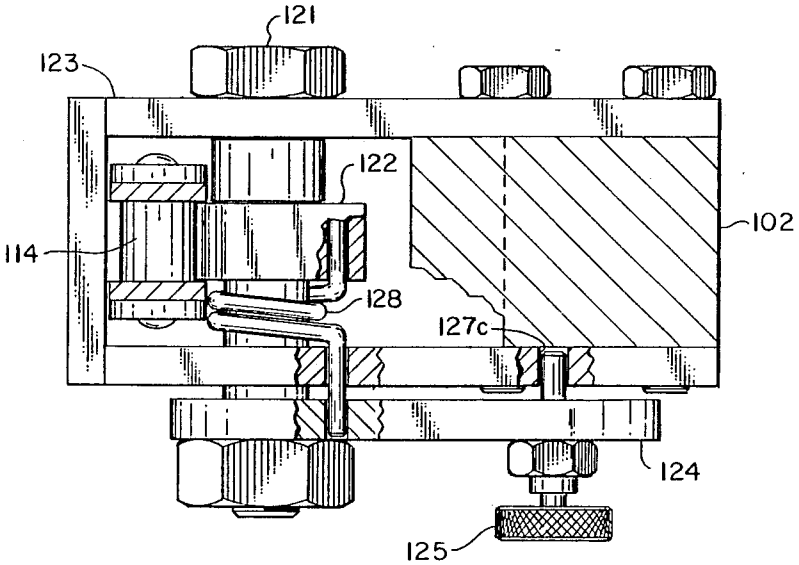
FIG. 17 is an enlarged sectional view of the power lift unit taken along the line 17–17 of FIG. 5.

With reference to the drawings wherein like numerals represent like parts throughout the several figures, a debris net lifting system in accordance with the present invention is generally designated by the numeral 10. The debris net system 10 comprises a plurality of substantially identical lifting units 12 which are spaced across the face of a high rise construction structure S as illustrated in FIG. 15. The lifting units are typically spaced twenty-five to thirty feet part, although the specific spacing may vary from application to application and in accordance with applicable governmental or regulatory requirements. The lifting system 10 supports a debris net 14 which extends forwardly away from the face of the structure S for catching debris which falls or is inadvertently dislodged from the structure. The debris net 14 is conventional and will not be described further.

Each lifting unit 12 comprises an inner support frame 16 and an outer lifting frame 18 which are slidably coupled together. The support frame and the lifting frame are each capable of independent mounting to the construction structure. As will be further described below, the support frame and the lifting frame are each slidable relative to the other, so that the lifting unit 12 is capable of essentially sequentially scaling the construction structure from platform-to-platform in an alternating hand and foot-like fashion. A hydraulic lift unit designated generally by the numeral 20 functions to alternately vertically displace the inner support frame 16 and the outer lifting frame 18, as will be described in detail below.

Figure 1:
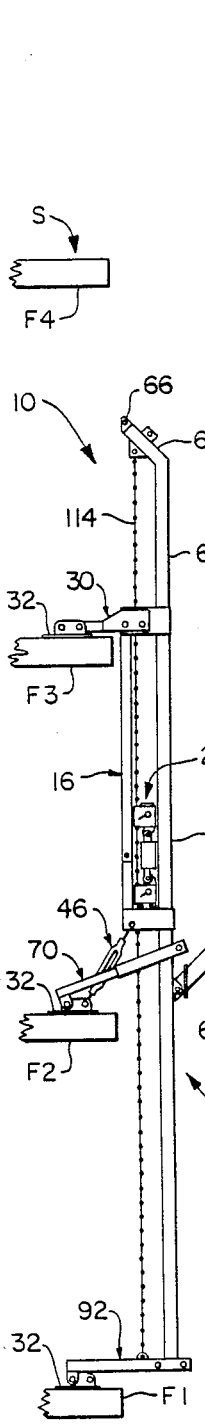
FIG. 1 is a side elevational view of a portion of the debris net lifting system of the present invention illustrated in connection with schematically illustrated floors of a high rise construction structure.
Figure 2:
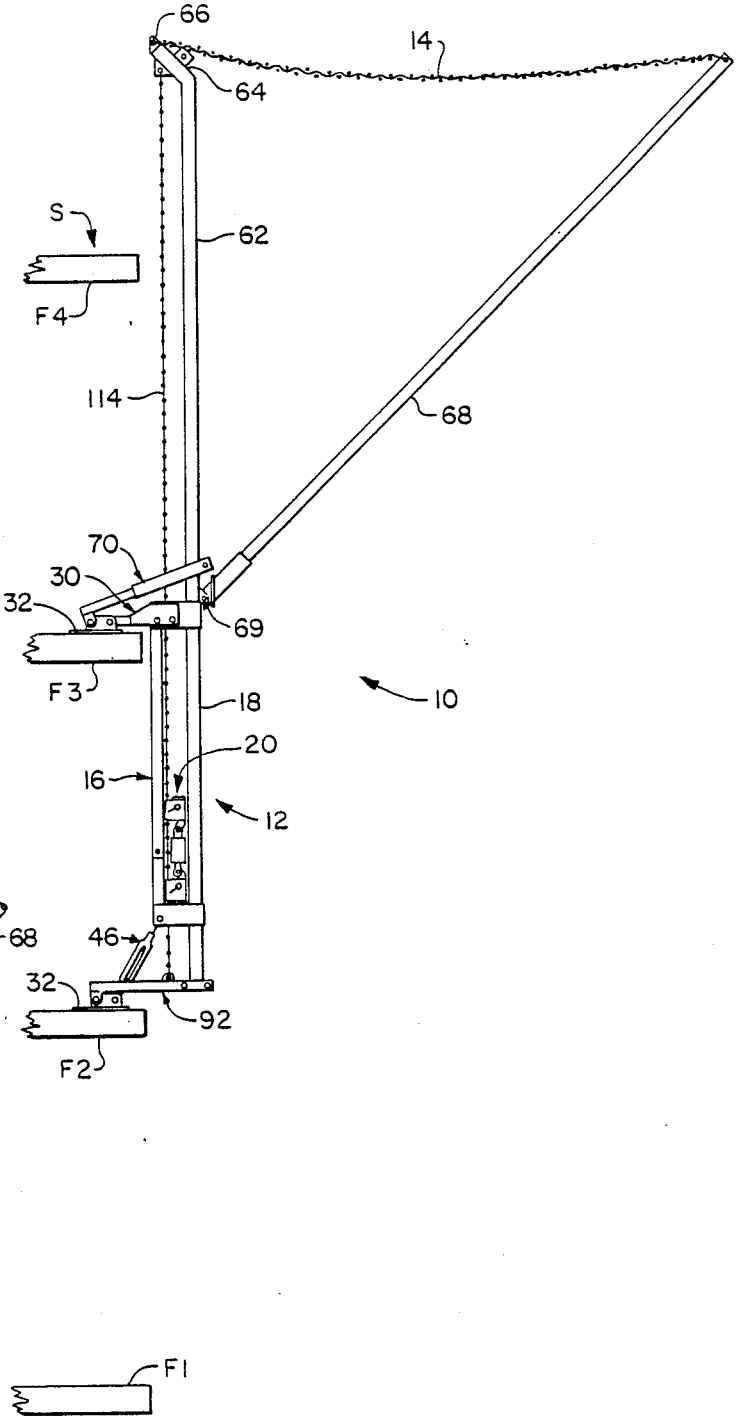
FIG. 2 is a side view of the lifting system and construction structure of FIG. 1 wherein the lifting system is illustrated at a succeeding vertical stage and the debris net and associated supports are more fully illustrated.

For purposes of illustrating the invention, platforms or floors of the construction structure S are designated in ascending order as F1, F2, F3, and F4 in FIGS. 1 and 2. The lifting system 10 may also be employed on structural steel beam-type structures. Accordingly, the terms "platform" and "floors" as described herein encompass steel beams and other horizontally oriented structural members.

The lifting unit 12 at an initial vertical height for supporting the debris net 14 at floor F3 is illustrated in FIG. 1. FIG. 2 illustrates the lifting system at the next vertical height wherein the debris net 14 is supported at floor F4 essentially one story or floor above the vertical height of FIG. 1. Although not illustrated, the lifting system configuration for the succeeding vertical height one floor above of that of FIG. 2 would be similar to that illustrated in FIG. 1, except that the inner support frame/outer lifting frame assembly would be displaced one floor above the depicted FIG. 1 illustration. Likewise, the lifting system configuration for the vertical height two floors above that of FIG. 2 would be similar to that of FIG. 2 except that the inner support frame/-outer lifting frame assembly would be displaced one floor above the depicted FIG. 2 illustration.

Figure 3:
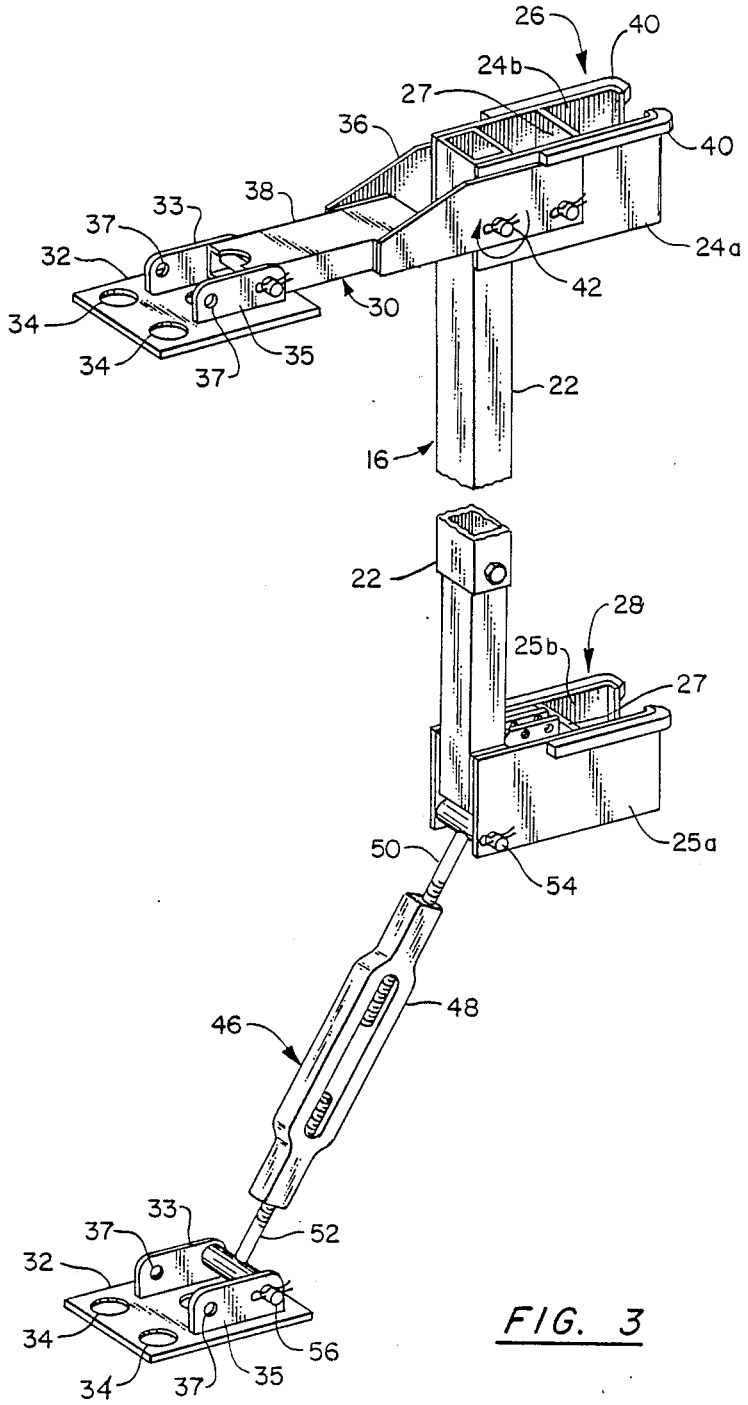
FIG. 3 is a perspective view, partly broken away, of the support frame of the lifting system of FIG. 1.

The construction and operation of lifting unit 12 can best be appreciated by separately considering the inner support frame 16 and the cooperative outer lifting frame 18. With reference to FIG. 3, the inner support frame 16 comprises a rugged support post 22 of heavy duty steel construction. Post 22, in the active mounting configuration, is oriented in an upright vertical position and normally spans a distance which is slightly less than the distance between adjacent floors of the structure. Opposing pairs of L-shaped members 24a, 24b and 25a, 25b project transversely (outwardly) from respective upper portions and lower portions of the support posts. Guide plates 27 extend between the members 24a, 24b and 25a, 25b to form longitudinally spaced, outwardly disposed guide slots 26 and 28 for slidably receiving the climbing frame 18. The guide slots 26 and 28 have substantially square shapes of substantially equal dimensions in the illustrated embodiment.

A mounting arm 30 is pivotally mounted to the support post 22 at an upper location surrounding side portions of the guide members 24a and 24b by means of bolts or pivot pins 42. The mounting arm 30 is a rugged bifurcated member which is detachably connectable to a mounting plate 32, as will be further described. The arm 30 comprises a bifurcated connector 36 which receives the pivot pins 42. The connector receives a brace arm 38 of quasi-U-shaped section. The brace arm 38 is welded to the connector 36. The arm has a pair of spaced apertures (not illustrated) near the terminus. The arm 30 may be independently connected through the apertures to a mounting plate 32 secured to a floor and be subsequently disconnected therefrom for vertical movement of the inner support frame. A pair of stiffening flanges 40 project laterally from an upper portion of the guide members 24a and 24b. The arm 30 is essentially upwardly pivotal (in the clockwise direction of the arrow illustrated in FIG. 3) about one pivot pin 42 upon pulling the other pin. The mounting arm functions to rigidly attach the upper portion of the inner support frame 16 to the construction structures so that the inner support post 22 is spaced outwardly away from the face of the structure.

Identical mounting plates 32 are normally mounted in generally vertical alignment on each of the floors near the face of the structure S. The mounting plates 32 are anchored to concrete fasteners or anchors. The mounting plates are employed to provide efficient attachment members for mounting the lifting unit 12 to the structure S with a high degree of mounting integrity. Each plate 32 has three spaced openings 34 for receiving the shanks of the anchors or fasteners. A pair of laterally spaced upstanding brackets 33 and 35 have apertures which are disposed to form an inbound set of aligned apertures 37 and a transversely spaced outboard set of apertures 39. The inboard apertures 37 receive connector pins or bolts for mounting the outer lifting frame 18. The outboard set of apertures 39 receive concrete pins or bolts for mounting the inner support frame 16.

A mounting leg assembly 46 is pivotally mounted at a lower portion of the post/guide members structure. The mounting leg assembly 46 comprise a turnbuckle 48 which threadably connects with a rigid T-connector 50 pivotally mounted to the pst 22. A pivot pin 54 is inserted through openings in lower guide members 25a and 25b and the T-connector 50 to provide the pivotal connection. A lower rigid T-connector 52 is pivotally mounted to a second mounting plate 32 via a pivotal connection between the upright-spaced mounting brackets 33 and 35. The T-connector is received between the brackets 33 and 35. The connection is secured by means of a pivot pin 56 inserted through the outboard apertures 39 of the mounting plate It will be appreciated that in FIG. 1, a mounting plate 32 for upper mounting arm 30 is secured to floor F3 and a second mounting plate 32 for the lower mounting leg assembly 46 is secured to floor F2. The support post 22 is spaced from the face of the floors F1 and F2 in a generally vertical orientation. The turnbuckle assembly 46 is employed to provide an adjustment for maintaining the desired vertical orientation of the support post 22. In addition, the mounting arm 30 is upwardly pivotal and the leg assembly 46 is pivotal about pin 54 so that the support frame 16, as a unit, may be moved to a higher or lower vertical position, as required, while generally maintaining the transverse spacing of the support post from the face of the floors. The mounting arm 30 and the support leg 46 thus essentially pivot to an angular position which provides sufficient clearance to allow the respective attachment members to pass in front of the face of the floors without the members interfering or engaging the edges of the floors. After the vertical post is correctly vertically positioned, the mounting arm 30 and the support leg 46 may then be positioned for attachment to mounting plates 32 anchored to corresponding floors.

Figure 4:
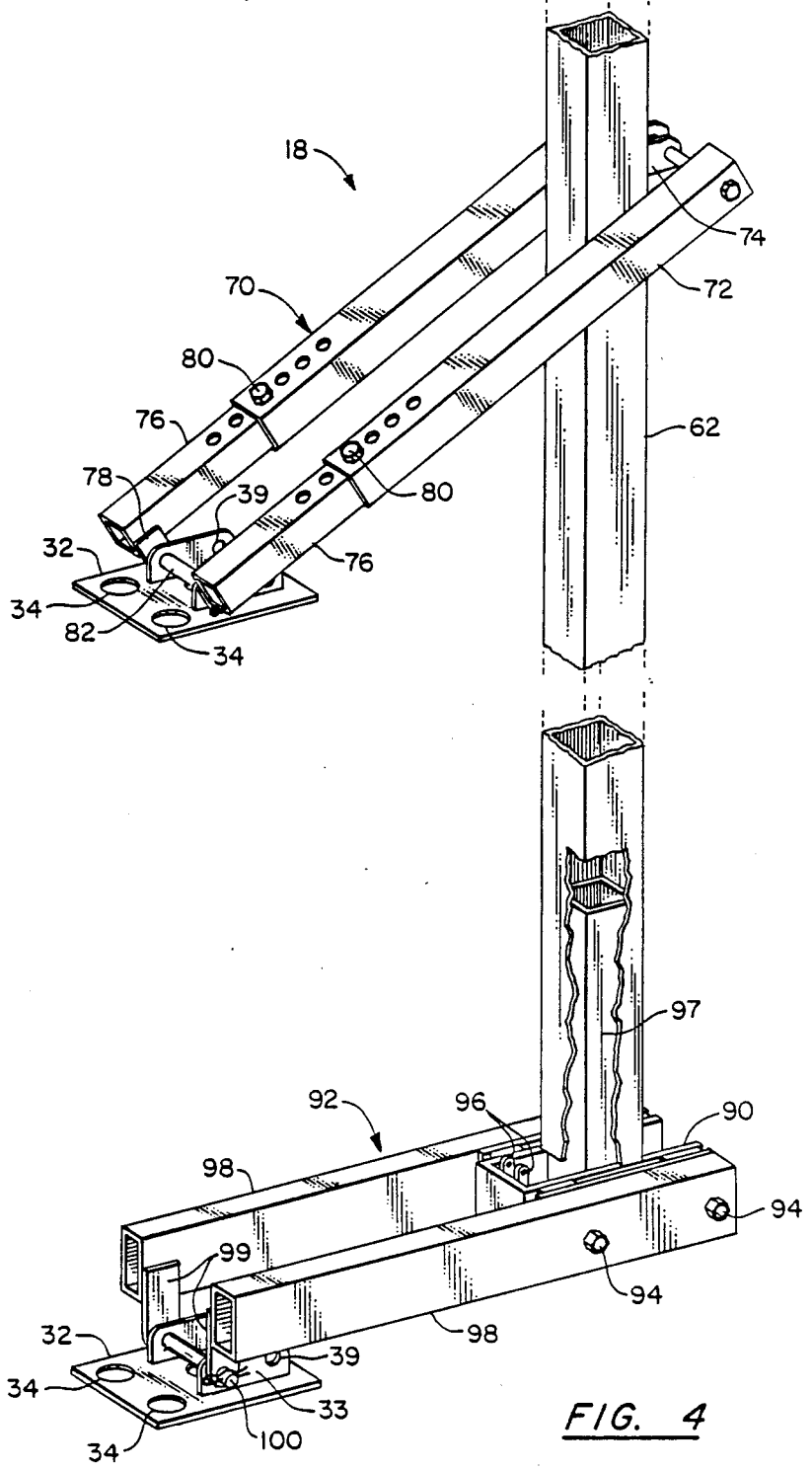
FIG. 4 is a fragmentary perspective view, partly broken away, of the lifting frame of the lifting system of FIG. 1.
Figure 5:
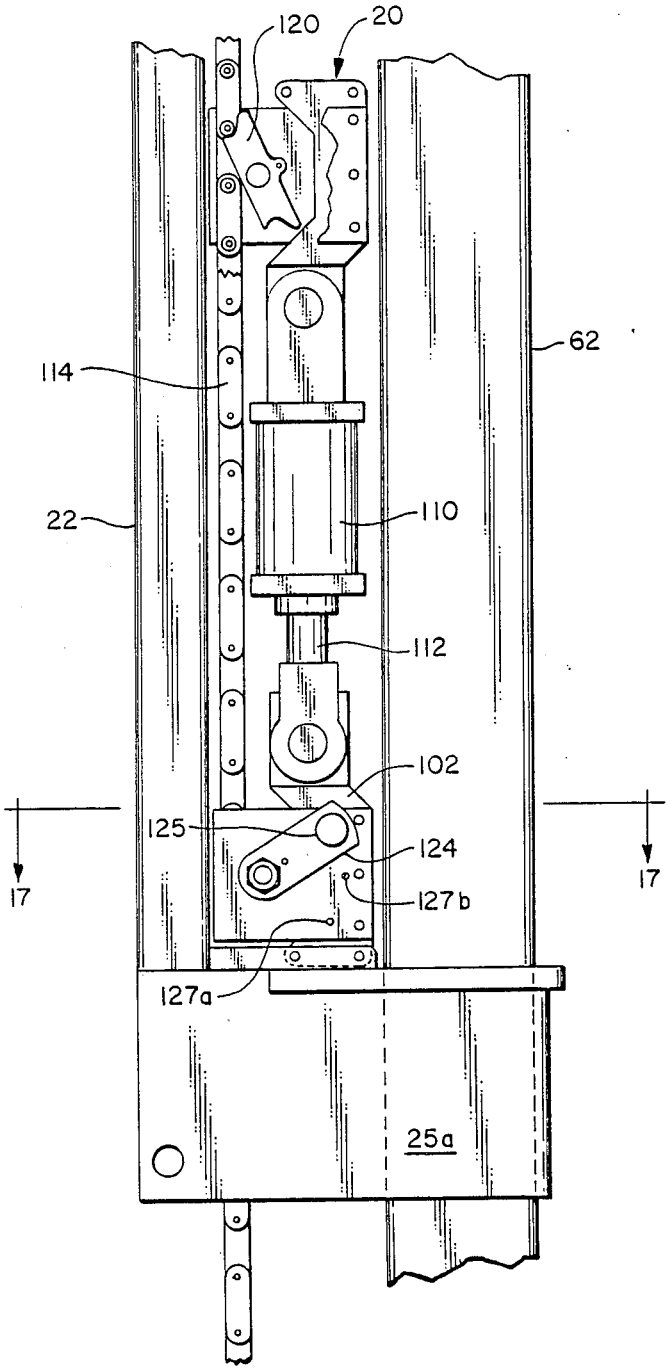
FIG. 5 is an enlarged fragmentary side view, partly broken away, of the power lift unit for the lifting system of FIG. 1.

With reference to FIGS. 2 and 4, the outer lifting frame 18 includes an elongated rigid support column 62 which preferably spans a vertical height which is greater than the height of two floors, or stated differently, a greater height than the vertical distance between three floors of the structures. An angled extension 64 at the top of the support column mounts a connector 66 which supports an inner cable to which one side of the debris net 14 attaches in close proximity to the construction structure.

Figure 16:
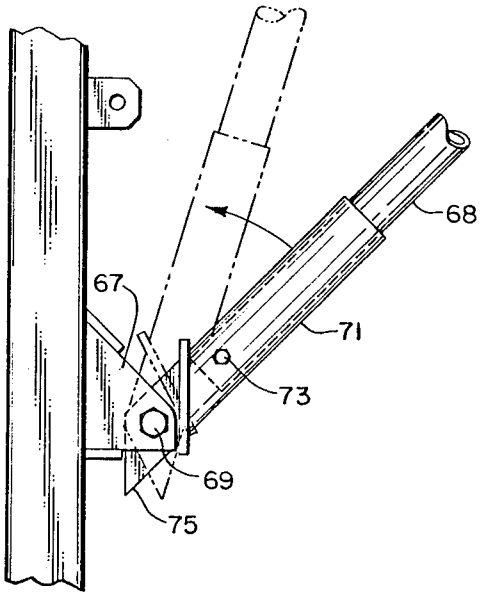
FIG. 16 is an enlarged fragmentary side view, partly in phantom away, of the lifting system of FIG. 2.

With additional reference to FIG. 16, a perimeter arm 68 extends from a socket assembly pivotal about a pin 69 at an intermediate portion of the support column 62 and projects obliquely therefrom to form the outer connecting support for the debris net 14. The perimeter arm 68 is received in a socket 71 and secured by a bolt 73. A tongue 75 integrally extends from the lower closed end of the socket. A pair of ears 67 integrally project from the support column 62. The tongue 75 is presented between the ears 67. The pivot pin 69 is inserted through aligned openings in the ears and tongue to provide the pivotal connections. The socket 71 is configured to interfere with the ears 67 to limit the downward pivoting of the perimeter arm. The pin assembly allows the perimeter arm 68 to pivot upwardly in a limited manner (direction of FIG. 16 arrow) so that the reaction forces of the perimeter arm may be effectively distributed and dissipated in the event an object falls in the debris net. The pin assembly socket/ear structure imposes a stop defining the normal angular position of the perimeter arm and prevents the arm from pivoting beyond the normal angular position in the downward direction.

The pin assembly ears are spaced to permit the pin assembly to slide between members 24a, 24b and 25a, 25b. The support column 62 is slidably received in the guide slots 26 and 28 of the inner support frame 16 to provide relative sliding movement between the support frame 16 and the lifting frame 18. The slots open outwardly through the opposing ends of members 24a, 24b and 25a, 25b to permit the pin assembly and hence the perimeter arm 68 to vertically pass along the slot openings without interference with guide members 24a, 24b and 25a, 25b.

With reference to FIG. 4, a bifurcated mounting arm 70 includes a quasi-U-shaped yoke 72 which is pivotally mounted between frontal studs 74 of the support column 62. The mounting arm 70 pivotally connects to the support column at an intermediate location which is located slightly above the fixed base connection of the boom 68. The pivotal connection is also configured to allow the mounting arm 70 to slide unhindered through the frontal openings of the guide slots 26 and 28. Telescoping extender struts 76 are received by socket-like structures of the U-shaped yoke 72. The struts 76 and the yoke 72 have series of alignable openings which receive bolt 80 for adjustably fixing the extension length of the mounting arm 70. Connector wings 78 welded at the ends of the struts 76 are positionable outside of mounting plate brackets 33 and 35. The wings have apertures which laterally align with inboard apertures 37 of the mounting plate 32 for pivotally coupling climbing frame struts 76 to the mounting plate by means of pins 82. The connector wings 78 are dimensioned and oriented to permit removal of the pin 82 from the apertures 37. The effective length of the mounting arm may be suitably adjusted to insure that the support column 62 extends in a substantially vertical (plumb) orientation It will be appreciated that the support column 62 is spaced outwardly from the support post 22 of the inner support frame, and the corresponding support column 62 and post 22 are generally parallel and are disposed outwardly from the face of the construction structures.

A cross-brace 90 is welded at a lower portion of an upright stud 97. The stud 97 is inserted into the lower end of the support column 62 A support leg assembly 92 is mounted by bolts 94 to the cross-brace One of the bolts 94 may be removed for pivoting the support leg assembly. The cross-brace also mounts a connector 96 which functionally connects with the hydraulic lift unit 20. The support leg assembly 92 includes a pair of spaced braces 98. Connector wings 99 welded to the braces extend perpendicularly thereto to enclose the brackets 33 and 35 of the mounting plate for pivotally connecting with the mounting plate. A pin 100 is inserted through apertures of the spaced wings and the inboard apertures 37 to couple the support leg assembly to the mounting plate. The wings 99 are dimensioned and oriented to permit the removal of the pin 100 from apertures 37.

It should be appreciated that the support leg assembly 92 is pivotal about a bolt 94 so that the outer lifting frame may be vertically displaced without the assembly 92 interfering or engaging the underside of a floor or the support frame. Likewise the mounting arm assembly 70 may be pivoted so that the assembly may clear the face of a floor when the outer lifting frame 18 as a unit is vertically raised.

As illustrated in FIG. 1, a mounting plate 32 for the support leg assembly 92 is mounted to rest on floor F1. The mounting plate 32 for he mounting arm assembly 70 is mounted to floor F2. In FIG. 2, the plate 32 for the support assembly 92 is secured to floor F2, and the mounting plate 32 for the mounting arm assembly 70 is secured to floor F3. The connections between the support leg assembly 92 and the mounting arm assembly 70 each are accomplished by inserting a pin through the inboard apertures 37 of the mounting plate with the respective connecting members being configured to enclose or mount over the upstanding brackets 33 and 35.

With reference to FIGS. 5 through 7 and 17, the power required for vertically displacing either the inner support frame 16 or the outer lifting frame 18 is supplied via the hydraulic lift unit 20. The hydraulic lift unit 20 comprises a hydraulic cylinder 110. The cylinder encloses a piston 111 having an actuator rod 112 which is connected to bracket 102. Bracket 102 is welded or otherwise fixed to the inner support frame 16. A heavy duty hoist chain 114 extends vertically from the underside of extension 64 to connector 96. Connecter 96 is welded or otherwise fixed to the cross-brace 90 of the lifting frame 18.

A pair of bi-polar ratchets 120 and 122 are pivotally mounted at verticllly-spaced positions of the hydraulic unit for ratcheting into drive engagement with the hoist chain 114 at either one of two drive directions. The ratchet assemblies are substantially identical. Ratchet housings 123 are each rigidly connected to brackets 102 which connect at opposing ends with the hydraulic cylinder 110. A shoulder pin 121 extends through opposing sides of the housing to pivotally mount ratchet 120 or 122. A directional selector lever 124 mounted to pin 121 selects the drive mode for the hydraulic cylinder by setting the ratchets in the proper directional engagement with the hoist chain. The angularly spaced detent openings 127*a*, 127*b*, and 127*c* of the housing are alignable with a threaded position rod 123 carried by a lever 124 for setting the drive direction. One end of the spring is inserted in a bore in the ratchet and the other end extends through a cam slot 125 in the housing. The spring bears against the end of the cam slot to improve the ratchet bias. Torisional springs 126 and 128 thus urge the ratchets 120 and 122 into their ratcheting engagements, respectively.

Figure 7:
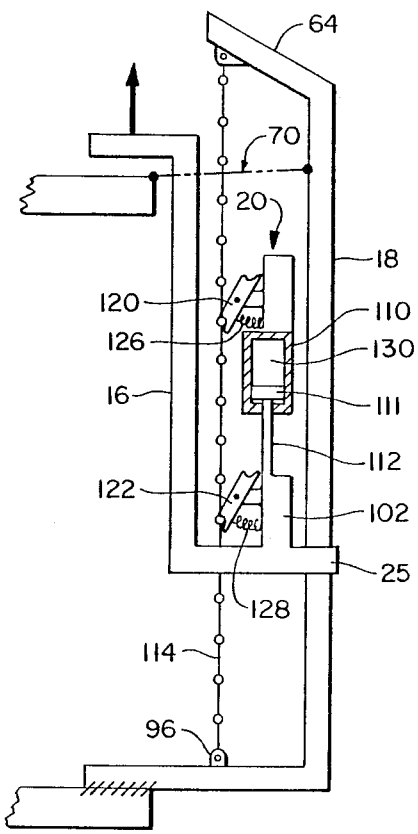
FIG. 7 is a schematic view illustrating a second lifting mode for the lifting system of FIG. 1.
Figure 6:
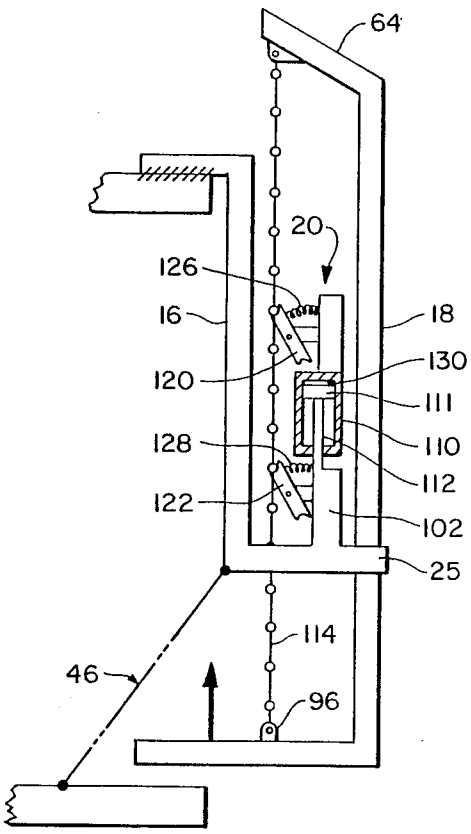
FIG. 6 is a schematic view illustrating a first lifting mode for the lifting system of FIG. 1.

There are two vertical displacement modes required to accomplish the climbing of the lifting unit. The displacement modes are schematically represented in FIGS. 6 and 7. In the hoist mode of FIG. 6, the hydraulic cylinder essentially functions to hoist the chain 114, which in turn is attached to the lifting frame 18, to thereby lift the outer lifting frame relative to the inner support frame. With specific reference to the hoist mode of FIG. 6, the inner support frame is attached in fixed rigid relationship to two floors. The hydraulic cylinder 11O is thus essentially mounted in fixed relationship to the support frame. The outer lifting frame has been disengaged from its respective mounting connections to the floors. The mounting arm 70 and the support leg assembly 92 are pivoted toward the support column 62. The FIG. 6 hoist mode represents the mode required to transform the lifting unit from the configuration of FIG. 1 to the configuration of FIG. 2.

As illustrated in FIG. 6, the ratchet arms 120 and 122 are engaged in a lift engagement against the hoist chain 114. As the hydraulic cylinder is activated, e.g., through pressure exerted in chamber 130 against piston 111, the ratchet arm 120 will be vertically displaced, thus raising the hoist chain and thereby the outer lifting frame. The lower ratchet arm 122 will limit the vertical descent of the hoist chain at the conclusion of the stroke of the piston. In preferred form, the stroke of the hydraulic cylinder is approximately 6½ inches. The cylinder strokes through approximately 4½ inches of actual work on the hoist chain 114. The outer lifting frame 18 may thus be hoisted in a ratcheting fashion by a series of strokes of the hydraulic cylinder until the correct vertical height of the outer lifting frame 18 is obtained.

When the correct height of the outer lifting frame is obtained, the mounting arm assembly 70 and the supporting leg assembly 92 of the lifting frame are then pivoted into position with corresponding mounting plates 32 and attached to the floors by coupling the assemblies to the respective mounting plates. The vertical orientation of the outer lifting frame 18 is maintained by adjusting the lengths or extensions of the struts. At this position, both the support frame 16 and the lifting frame 18 are securely fastened to the construction structures. It should be appreciated that the support arm assembly 70 is attached through the inboard apertures 37 of the mounting plate brackets. The outboard apertures 39 are employed to attach the inner support frame to the mounting plate. Likewise, the support leg assembly 92 may be connected via the inboard apertures 37 of a lower mounting plate 32.

The climbing mode wherein the inner support frame 16 essentially climbs the hoist chain 114 to a new vertical position is illustrated in FIG. 7. The FIG. 7 climbing mode represents the mode required to transform the lifting unit from the configuration of FIG. 2 to an upper mounting configuration equivalent to the configuration of FIG. 1. In FIG. 7, the lifting frame 18 is rigidly secured to the structures. The support frame 16 is detached from its anchoring to the respective floors. The mounting arm 30 and the support leg assembly 46 are pivoted against support post 22. The ratchet arms 120 and 122 are pivoted downwardly for ratchet engagement against the hoist chain. Since the hydraulic cylinder is fixed in relation to the inner support frame, actuation of the hydraulic cylinder causes a ratcheting against the hoist chain 114 thereby resulting in the support frame 16 essentially climbing the hoist chain under the successive ratcheting strokes. Once the inner support frame 16 is vertically displaced to the desired new height, the mounting arm 30 and the mounting leg assembly 46 are positioned against corresponding mounting plates and are each anchored to a mounting plate 32 by means of bolts inserted through the outboard apertures 39. Both the inner support frame 16 and the outer lifting frame 18 are thus rigidly anchored to the structure S at the new vertical height.

The hoisting mode and the climbing mode are alternately employed for each successive vertical climb from one floor to another up the side of the construction structure. In summary, when the outer lifting frame 18 is vertically hoisted, the inner support frame 16 is fixed to the structure S and the mounting arm 70 and the support leg assembly 92 are suitably pivoted to allow the raising of the outer lifting frame without either the mounting arm or the support leg engaging or interfering with the underside of a floor after the floor is cleared by the respective members. Likewise, when the inner support frame 16 is vertically displaced, the outer lifting frame 18 is fixed to the structure S and the mounting arm 30 and the mounting leg assembly 46 are suitably pivoted to provide sufficient clearance with the face of the floors to allow for the mounting arm 30 and the mounting leg assembly 46 to pass without hindrance or interference with the floor. The lifting or climbing process is accomplished with the debris net 14 being fully extended and functional for its intended purpose. The debris net 14 is not required to be folded or otherwise dismounted during the described climbing process.

The lifting unit 12 may be lowered rather than raised by reversing the foregoing described climbing process. The climbing process has essentially been described with respect to a single lifting unit 12 Each of the lifting units 12 of a given debris net section are also sequentially vertically displaced in incremental fashion In preferred form, a centralized power pack 140 (FIG. 15) has a circuit 142 which is attached to each cylinder 110 of the respective hydraulic units 20.

With reference to FIG. 15, the lifting units 12 in one application are spaced on the order of approximately 25 to 30 feet across the side of the structure S. The spacing between lifting units depends on the dimensions of net 14. In order to insure that the impact forces against the debris net 14 are properly transferred and distributed, tubes 150 may be mounted for connection between outer ends of adjacent perimeter arms 68. In addition, cables 152 may be employed to tie off between lifting units and adjacent perimeter or debris net projecting portions. It will, of course, be appreciated that for very large building sites, numerous lifting units may be employed. The lifting units 12 are gradually lifted in sequence by incremental strokes of the respective power cylinders so that the vertical height of the debris net 14 along a given structure side is generally maintained within a few inch variance.

Each mounting plate 32 is preferably fastened to the floor at a location such that the center line between apertures 37 and 39 is approximately 12 inches from the edge or face of the concrete floor F. Because the floor is ordinarily constructed of reinforced steel concrete, anchoring of the mounting plate can be problematical if the fastener happens to be driven into a steel reinforcement rod. The fasteners may be concrete anchors or cast-in studs. Naturally, the mounting plate must be anchored to the floor with a high degree of anchoring integrity At least two, and preferably three, fasteners are employed for each mounting plate 32. For steel beam structures, the plates are mounted directly to the steel beams. The lifting unit 12 has sufficient clearance from the face of the steel structure to allow the lifting system to be readily adapted for structural steel beam applications.

Figure 8:
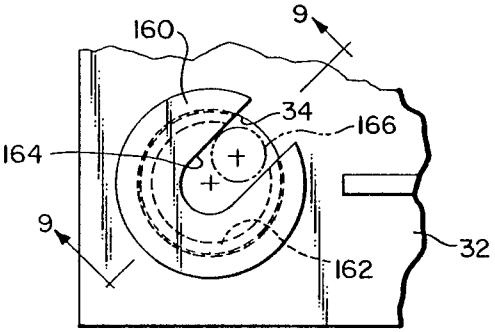
FIG. 8 is an enlarged fragmentary top view, partly in phantom, of a mounting portion of the lifting system of FIG. 1.
Figure 9:
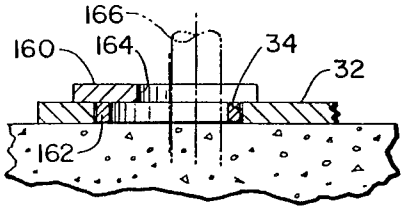
FIG. 9 is an enlarged fragmentary sectional view of the mounting portion taken along the line 9—9 of FIG. 8.

With reference to FIGS. 8 and 9, the fastener openings 34 of the mounting plate receive a steel key plate 160. The key plate 160 includes a flange-like arcuate guide rim 162 which is generally commensurate with the shape of the inside edge of the mounting plate opening. The key plate 160 has an upper surface which defines an eccentric slot 164. The key plate is angularly rotatable. The eccentric slot 164 provides an opening in the plate engagement surface for fastening the mounting plate at any location of the opening 34. In the event that a reinforcement rod or other such obstruction is encountered by a fastener, the key plate 160 may be suitably rotated, and the anchoring fastener shank 166 located along the eccentric slot to avoid the obstruction.

The vertical expanse or span of the inner support frame 16 and the outer lifting frame 18 must be selected in accordance with the floor spacings for the construction structure as well as the regulatory requirements as to the height of the debris net. For structures wherein the floor spacing is uniform throughout, once the pre-established dimensions have been implemented for the given application, no further adjustment is required. However, the invention contemplates applications wherein the vertical spacing for a given structure may not be uniform, such as, for example, when an enlarged utility floor is interposed at an intermediate floor height. In addition, the invention may be adapted so that a given lifting unit 12 can be employed for buildings having different vertical floor spacings.

Figure 12:
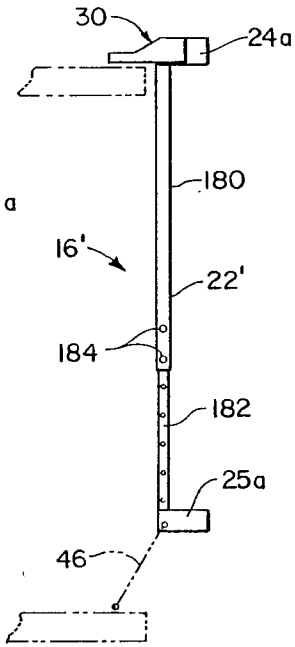
FIG. 12 is a schematic side view of the telescopic embodiment of FIG. 11 illustrating a second stage of the embodiment thereof.
Figure 11:
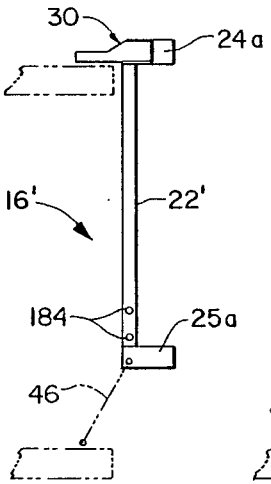
FIG. 11 is a schematic side view of a telescopic embodiment of a support frame illustrating a first stage of the telescopic feature thereof.
Figure 10:
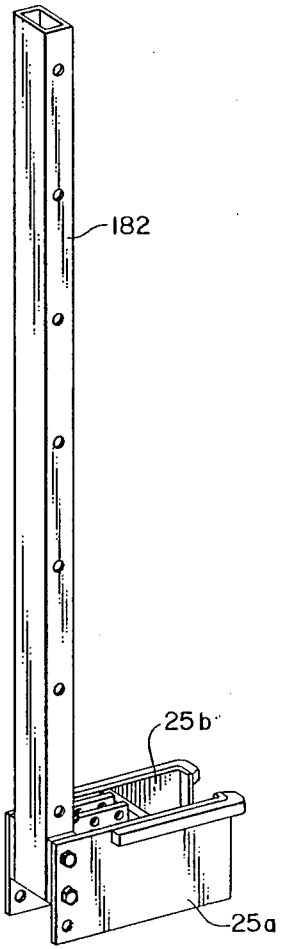
FIG. 10 is a fragmentary perspective view of a section of the support frame for a telescopic embodiment of the support frame of FIG. 1.

The varying dimensional requirements may be implemented for a given application by an adjustable support frame 16' as best illustrated in FIGS. 10 through 12. The support post 22' of the support frame is essentially composed of two telescopic post sections 180 and 182. Each of the post sections have longitudinally spaced sets of apertures which are alignable with apertures of the other member to form a series of adjustable extensions. Bolts 184 may be inserted through the appropriate aligned apertures to fix the longitudinal dimension for a given application.

For purposes of contrast, a support frame embodiment for a standard floor height is illustrated in FIG. 11. A support frame embodiment for an enlarged floor height such as a utility floor is illustrated in FIG. 12 wherein the telescopic sections 160 and 162 are extended to accommodate the enlarged height. When the mounting arm assembly 30 and the mounting leg 46 are detached from their anchoring engagement with the respective floors for the FIG. 12 application, the length of the support posts may be re-adjusted (retracted) to the normal height adjustment prior to vertically displacing the support frame 16' to the new height.

Figure 13:
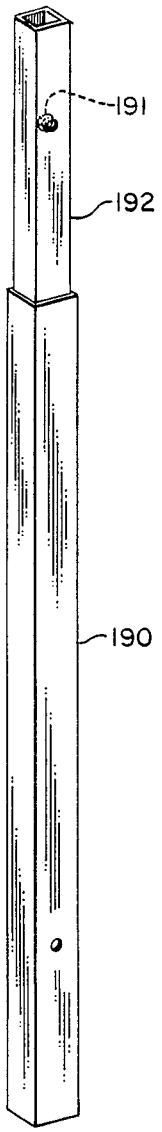
FIG. 13 is a perspective view of an extender member for the lifting frame of FIG. 4.
Figure 14:
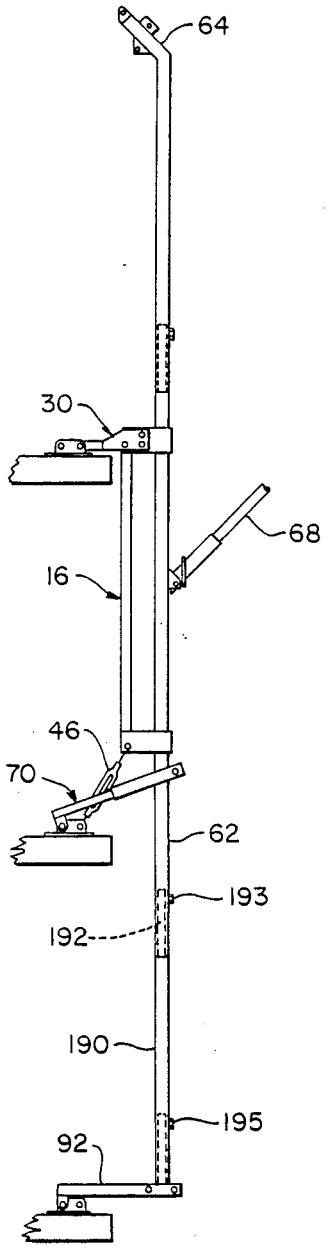
FIG. 14 is a fragmentary side view, partly in phantom, illustrating an extended embodiment for the lifting frame of FIG. 4.

The vertical span of the support column 62 of the outer lifting frame 18 ordinarily does not require as precise an adjustment as that of the inner support frame. With reference to FIGS. 13 and 14, an extender column 190 has an integral projecting reduced tongue 192. The tongue 192 may be inserted into the lower end of the support column 62 to provide an extended expanse as illustrated in FIG. 14. A dead nut 191 is welded at an interior location of the tongue 192. A bolt 193 threads into the nut 191 to lock the extender column 190 to the support column 62. The lower portion of the extender column 190 connects with the support leg assembly 92 by slipping over stud 97 in the manner previously described for column 62 and assembly 92. A bolt 195 is threaded to a dead nut welded at the column interior to lock the extender column 190 to the stud 97. The extender column 190 may be removed when not needed.

While a preferred embodiment of the foregoing invention has been set forth for purposes of illustration, the foregoing description should not be deemed a limitation of the invention herein. Accordingly, various modifications, adaptations, and alternatives may occur to one skilled in the art without departing from the spirit and the scope of the present invention.

What is claimed is:

1. A debris net lifting system for climbing series of vertically spaced platforms to provide a moveable support for a debris net comprising:

first frame means for detachable mounting to two platforms to provide a rigid support, said first frame means comprising:

a rigid inner support frame positionable in a generally upright orientation spaced transversely from said platforms at a first distance;

lower inner attachment means connected to said inner support frame for attachment to a first platform, said lower inner attachment means comprising lower variable positioning means for positioning said lower inner attachment means to permit vertical displacement of said first frame means between platforms while generally maintaining said first distance;

upper inner attachment means connected to said inner support frame for attachment to a second platform, said upper inner attachment means comprising upper inner positioning means for variably positioning said upper inner attachment means to permit vertical displacement of said first frame means between platforms while generally maintaining said first distance;

guide means disposed in fixed relationship to said inner support frame;

second frame means slidably received in said guide means for detachable mounting to two platforms to provide a rigid support, said second frame means comprising:

a rigid outer lifting frame positionable in a generally upright orientation spaced transversely from said platforms at a second distance;

lower outer attachment means connected to said outer lifting frame for attachment to one platform, said lower outer attachment means comprising lower variable positioning means for variably positioning said lower outer attachment means to permit vertical displacement of said second frame means between platforms while generally maintaining said second distance;

upper outer attachment means connected to said outer lifting frame for attachment to another platform, said upper outer attachment means comprising upper outer positioning means for variably positioning said upper outer attachment means to permit vertical displacement of said second frame means between platforms while generally maintaining said second distance;

net support means extending from said second frame means for supporting a debris net.

2. The lifting system of claim 1 further comprising lifting means for lifting said second frame means relative to said first frame means when the position of said first frame means is substantially fixed to two of said platforms and for lifting said first frame means relative to said second frame means when the position of said second frame means is substantially fixed to two of said platforms.

3. The lifting system of claim 2 wherein said lifting means comprises a hydraulic cylinder which is mounted in fixed relationship to said first frame means.

4. The lifting system of claim 3 further comprising a hoisting chain which connects to said second frame means and further comprising ratchet means for selectively engaging against said chain to provide a ratchet drive in one of two directional drive modes, said ratchet means being drivable by said hydraulic cylinder means.

5. The lifting system of claim 4 wherein said ratcheting means further comprises a pair of bi-polar vertically spaced ratcheting arms.

6. The lifting system of claim 1 wherein said rigid inner support frame includes means for adjusting the effective length of said inner support frame.

7. The lifting system of claim 1 wherein the lower inner attachment means comprises a turnbuckle and a pair of connectors threadably received by said turnbuckle, and said lower variable positioning means comprises a connector pivotally mounted to said inner support frame.

8. The lifting system of claim 1 wherein said upper inner attachment means comprises an attachment arm, and said upper inner positioning means comprises a pivotal connection between said attachment arm and said inner support frame.

9. The lifting system of claim 1 wherein said guide means further comprises a pair of opposing generally L-shaped members which cooperate to define a longitudinally extending slot having a longitudinally extending opening at the outer transverse extent thereof.

10. The lifting system of claim 1 wherein said outer lifting frame further comprises a generally longitudinally extending support post defining a longitudinal axis, said post having an extension at an end portion thereof, said extension extending at an angle to the longitudinal axis.

11. The lifting system of claim 1 wherein said net support means further comprises a perimeter arm which projects outwardly relative to said second frame means.

12. The lifting system of claim 11 further comprising a debris net which is suspended between an upper portion of said second frame means and an outer portion of said perimeter arm.

13. The lifting system of claim 1 wherein said lower outer attachment means comprises a support leg and said lower variable positioning means comprises a pivotal connection between said leg and said outer lifting frame.

14. The lifting system of claim 1 wherein said upper outer attachment means comprises an arm which has variable length adjustment means for adjusting the length of said arm, and said upper outer positioning means comprises a pivotal connection between said arm and said outer lifting frame.

15. The lifting system of claim 1 wherein said inner support frame has length adjustment means for variably implementing an adjustable fixed length.

16. The lifting system of claim 1 further comprising means for extending the longitudinal span of the outer lifting frame.

17. The lifting system of claim 1 further comprising mounting plate means, said mounting plate means defining an opening and a pair of upstanding spaced bracket members defining first and second sets of pairs of aligned apertures.

18. The lifting system of claim 17 wherein a mounting plate may be anchored to a given platform and the lower inner attachment means of said first frame means is connectable through said first set of apertures and the upper outer attachment means of said second frame means may be connected through said second set of apertures.

19. The lifting system of claim 17 wherein said mounting plate may be anchored to a given platform and the lower outer attachment means of said second frame means may b connected to said plate through said second set of apertures and the inner lower attachment means of said first frame means may be connected to said plate through said first set of apertures.

20. The lifting system of claim 17 wherein said mounting plate may be anchored to given platform and said upper outer attachment of said second frame means may be mounted through said second set of apertures and said upper inner attachment of said first frame means may be mounted through said second set of apertures.

21. The lifting system of claim 17 further comprising a key plate defining an eccentric slot, said key plate being receivable in the opening of said mounting plate and being angularly adjustable therein.

22. A debris net lifting system for climbing a series of vertically spaced platforms to provide a moveable support for a debris net comprising:

first frame means for detachable mounting to two platforms to provide a rigid support, said first frame means comprising:

a rigid inner support frame positionable in a generally upright orientation spaced transversely from said platforms at a first distance;

lower inner attachment means connected to said inner support frame for attachment to a first platform;

upper inner attachment means connected to said inner support frame for attachment to a second platform;

guide means disposed in fixed relationship to said inner support frame;

second frame means slidably received in said guide means for detachable mounting to two platforms to provide a rigid support, said second frame means comprising:

a rigid outer lifting frame positionable in a generally upright orientation spaced transversely from said platforms at a second distance;

lower outer attachment means connected to said outer lifting frame for attachment to one platform;

upper outer attachment means connected to said outer lifting frame for attachment to another platform;

net support means extending from said second frame means for supporting a debris net;

lifting means for lifting said second frame means relative to said first frame means when the position of said first frame means is substantially fixed to two of said platforms and for lifting said first frame means relative to said second frame means when the position of said second frame means is substantially fixed to two of said platforms.

23. The lifting system of claim 22 wherein said lifting means comprises chain means connected to one of said frame means and a hydraulic cylinder connected in fixed relationship to said other frame means.

24. The lifting system of claim 23 further comprising ratchet means drivable by said hydraulic cylinder for selectively engaging said chain means to provide a ratchet drive.

25. The lifting system of claim 22 wherein said inner support frame generally maintains said first distance when said first frame means is lifted by said lifting means.

26. The lifting system of claim 22 wherein said outer lifting frame generally maintains said second distance when said second frame means is lifted by said lifting means.

27. The lifting system of claim 22 further comprising first adjustment means for adjusting the position of the first frame means to obtain a substantially vertical orientation of said inner support frame.

28. The lifting system of claim 22 further comprising second adjustment means for adjusting the position of the second frame means to obtain a substantially vertical orientation of said outer lifting frame.

29. A debris net lifting system for climbing a series of vertically spaced platforms comprising:

a plurality of laterally spaced lifting units anchorable to said platforms;

a debris net suspended from said lifting units so as to extend generally laterally and outwardly from said platforms at a first pre-selected vertical height;

each said lifting unit comprising:

first frame means comprising inner upper and inner lower attachment means for independent mounting to respective spaced platforms;

second frame means slidably coupled to said first frame means comprising outer upper and outer lower attachment means for independent mounting to respective spaced platforms, said second frame means comprising suspension means for suspending said debris net;

so that one said frame means may be vertically displaced from said first height to a second vertical height while the other said frame means is mounted in fixed relationship to selected platforms with the debris net being suspended from said unit and supported on said selected platforms during the vertical displacement of said one frame means.

30. The lifting system of claim 29 wherein said other frame means may be vertically displaced from said second vertical height to a third vertical height while the one said frame means is mounted in fixed relationship to a second set of selected platforms with the debris net being suspended from said unit and supported on said second platform set during the vertical displacement of said other frame means to the third vertical height.

31. The lifting system of claim 29 further comprising lifting means for lifting a said frame means relative to another said frame means.

32. The lifting system of claim 29 further comprising positioning means for selectively independently positioning each said attachment means to permit vertical displacement of a frame means without said corresponding upper and lower attachment means engaging platforms.

* * * * *